United States Patent [19]

Zimmermann et al.

[11] Patent Number: 4,648,147

[45] Date of Patent: Mar. 10, 1987

[54] SUPPORT FOR A TENSION TIE MEMBER, SUCH AS A DIAGONAL CABLE IN A STAYED GIRDER BRIDGE

[76] Inventors: Egbert Zimmermann, Oberaudorf; Oswald Nützel, Munich, both of Fed. Rep. of Germany .

[21] Appl. No.: 728,756

[22] Filed: Apr. 30, 1985

[30] Foreign Application Priority Data

Sep. 21, 1984 [DE] Fed. Rep. of Germany ..... 3434620

[51] Int. Cl.[4] ..... E01D 11/00

[52] U.S. Cl. ..... 14/21; 14/22

[58] Field of Search ..... 14/18–23; 404/70; 52/223 L, 223 R, 230, 148, 151; 254/29 A; 403/227, 228, 221

[56] References Cited

U.S. PATENT DOCUMENTS

| | | | |
|---|---|---|---|
| 3,066,581 | 12/1962 | Goldbeck | 404/70 |
| 3,119,203 | 1/1964 | Finsterwalder | 52/223 L |
| 3,156,169 | 11/1964 | Finsterwalder | 404/70 |
| 3,632,724 | 1/1972 | Hilgeman, Jr. | 52/223 R |
| 3,755,880 | 9/1973 | Simms | 254/29 A X |
| 3,937,607 | 2/1976 | Rodormer | 52/223 L X |
| 3,967,421 | 7/1976 | Dufossez | 52/230 X |
| 4,473,915 | 10/1984 | Finsterwalder | 14/21 |

FOREIGN PATENT DOCUMENTS

| | | | |
|---|---|---|---|
| 2911226 | 10/1980 | Fed. Rep. of Germany | 52/223 R |
| 8501080 | 3/1985 | Fed. Rep. of Germany | 14/21 |

*Primary Examiner*—James A. Leppink
*Assistant Examiner*—Matthew Smith
*Attorney, Agent, or Firm*—Toren, McGeady and Goldberg

[57] ABSTRACT

A tension tie member is anchored between two spaced locations on a structure, such as a diagonal cable in a stayed girder bridge. The tie member is supported on the structure adjacent at least one anchor location by an annular bearing member encircling an outer protective casing of the tie member. The bearing member is positioned within an annular chamber in the structure at the point where the tie member extends through the structure toward the anchor location. The diameter of the annular chamber is larger than the diameter of the tie member so that there is a certain amount of play between the bearing member encircling the tie member and the surface of the annular chamber whereby lateral movement of the tie member can occur. With the tie member anchored in place the space between the outside of the bearing member and the inside surface of the annular chamber can be filled with grout to support the tie member.

15 Claims, 4 Drawing Figures

SUPPORT FOR A TENSION TIE MEMBER, SUCH AS A DIAGONAL CABLE IN A STAYED GIRDER BRIDGE

BACKGROUND OF THE INVENTION

The present invention is directed to a support for a tie member tensioned between and anchored to different parts of a structure. The tensioned tie member is formed of steel wires, steel strands, rods or like enclosed within the protective casing, such as a diagonal cable in a stayed girder bridge. The support is provided at least at one of the points where the tie member enters into the structure to which it is anchored.

Tie members of this type used for anchoring component parts of a structure are, as a rule, positioned within a channel or passageway extending through the component part along with the protective casing so that the tie member can be moved longitudinally relative to the structure and anchored at a location opposite the point where the member enters into the structure. This is the situation where a diagonal cable for a stayed girder bridge is anchored to the tower and the roadway girder of a bridge.

Certain deformations occur in the transverse longitudinal directions of the diagonal cable, caused by alternating stresses due to temperature differences, and also due to live loads and wind loads which develop at the locations where the diagonal cable passes into the structure. If the diagonal cable is guided through the structure with sufficient play, different movements of the cable in the region of its anchor may produce bending moments which have an unfavorable influence on the strength of the cable. To reduce the effect of any movement or deformation, the cable can be reinforced in the region where it enters the structure, for example, it can be guided in a steel tube. In such an arrangement deformation is reduced and the fatigue behavior is improved. Further, transverse movements of the cable can be prevented if it is supported relative to the structure at the location where it enters the structure. In this way any transverse movements of the cable are spaced from the cable anchor, regardless of their origin.

Certain conditions must be provided for such a support, that is, there must be a certain amount of play between the cable and the structure during its installation. The structure should not be destroyed under a continuous load.

SUMMARY OF THE INVENTION

The primary object of the present invention is to provide a support for a tension tie member of the type described above at the location where the member enters into part of a structure adjacent the location where it is anchored so that any constructional tolerances are compensated and a support for the member is achieved which is reliable in all directions.

In accordance with the present invention a tension tie member extends unsupported between two parts of a structure to which it is anchored and the member is made up of elongated steel wires, steel strands or the like laterally enclosed by a protective casing. Preferably, the tension tie member is a diagonal cable for a stayed girder bridge. At the point where the tie member enters the part of the structure to which it is anchored, an annular bearing member laterally surrounds the protective casing and is positioned in an annular chamber located at the place where the tie member enters the part of the structure. The diameter of the inside surface of the annular chamber is greater than the outside diameter of the bearing member. With the annular bearing member in position about the tie member a hardenable material is grouted into the chamber filling the cavity between the outside surface of the bearing member and the surface of the annular chamber.

The annular chamber can be formed directly in the part of the structure through which the tie member passes or it can be formed by a steel support tube laterally surrounding the tie member and securely connected to the part of the structure.

The bearing member can be in the form of a closed ring that can be slid onto the tie member. It would also be possible to form the bearing member as an open ring which can be placed on the tie member by spreading it and then fitting it on to the member. Preferably, the bearing member is formed of plastics material or rubber, for instance neoprene or the like.

A sliding layer, such as a sheet metal strip, can be placed between the bearing member and the exterior surface of the tie member.

The inside surfaces of the annular chamber can be provided with a coating which inhibits bonding action with the hardenable material so that the tie member and the support can be replaced.

In producing a support of this type, after the tie member is assembled on the structure, the bearing member is placed into an annular chamber formed in the part of the structure to which the tie member is anchored. The annular chamber is open on one surface so that the bearing member can be inserted and, after closing the opening with an annular pressure plate, the bearing member is subjected to axial pressure by the pressure plate and seals the annular chamber at the front opening. Next, the space remaining within the annular chamber outwardly of the bearing member is grouted with a hardenable material. The grouting of the bearing member within the annular chamber is effected preferably after the tie member is tensioned to the desired amount.

A particular advantage of the invention is that the annular bearing member serving to support the tie member is arranged in an annular chamber so that, together with the tie member, there is a considerable amount of play in the radial direction during the assembly and construction operation. With this play available, manufacturing tolerances can be compensated and movements of the tie member during tensioning or as a result of temperature differences can be absorbed to a certain degree. By grouting the space within the annular chamber laterally outwardly from the bearing member with a hardenable material, the tie member can be fixed in the final position. Since it is possible to fill the space with a hardenable material for a short period, the grout material can be selected according to its setting period and it is also possible in this manner to fix the tie member at a predetermined point in time in a given position. After the grouting material sets, the bearing member is fixed within the structure so that transverse movements are no longer possible, however, longitudinal movement of the tie member can occur due to the sliding layer located between the inside of the annular bearing member and the surface of the tie member.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
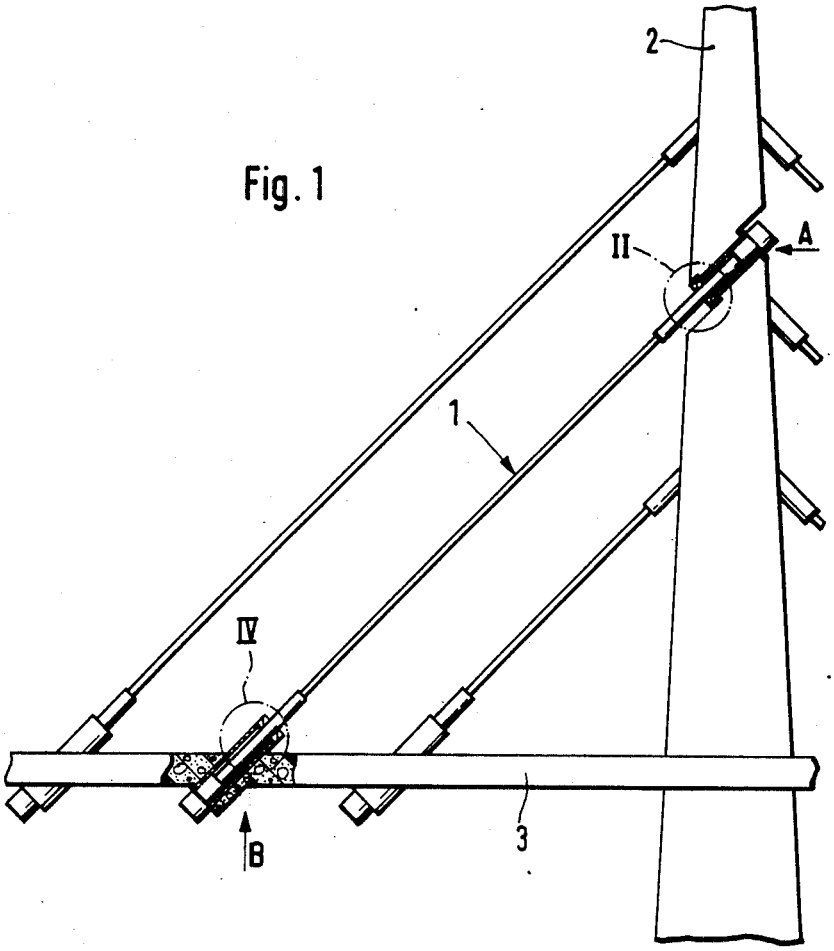
FIG. 1 is a schematic elevational view of a tie member, embodying the present invention, in the form of a diagonal cable for a stayed girder bridge.

The invention is illustrated in the drawing in the form of a diagonal cable 1 for a stayed girder bridge. FIG. 1 is a schematic illustration of a side view of such a bridge with a tower 2 formed of reinforced concrete and a roadway girder 3 also formed of reinforced concrete or prestressed concrete. The invention, however, is not limited to stayed girder bridges or to the above-mentioned materials for the tower and roadway girder.

Each diagonal cable 1 extends through the tower 2 and the roadway girder 3 in a duct or passageway so that the cable is longitudinally movable and it is anchored on the opposite side of the tower 2 from the point where it passes through the tower in an anchor unit A and the opposite end of the cable is secured at an anchor unit B located on the underside of the roadway girder 3. In other words, the cable 1 is anchored on the side of the roadway girder and tower which are remote from one another.

Figure 3:
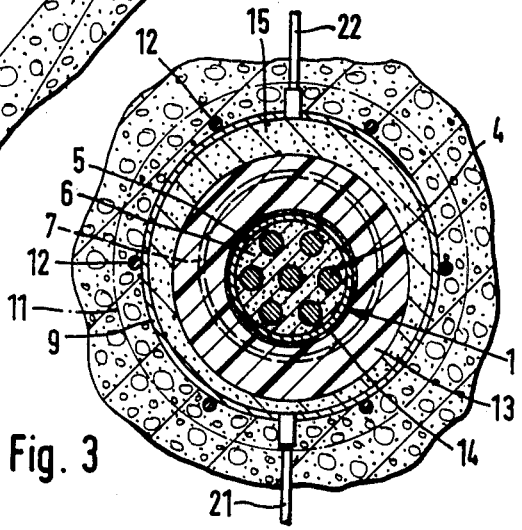
FIG. 3 is a sectional view taken along the line III—III in FIG. 2.

The diagonal cable 1 is made up of a bundle of individual elements 4, note FIG. 3, such as steel rods, wires or strands laterally enclosed within an axially extending protective casing 5. Within the casing 5 a hardenable material 6 is placed about the individual elements 4. The hardenable material 6 can be a cement mortar or grout. The protective casing is an elongated tubular member formed of plastics material or steel between the two parts of the bridge or structure, however, in the region of the anchor units A and B and in the region where the cable extends through the structure, preferably the casing is formed as a steel tube. The formation of the tie rod does not involve the subject matter of the present invention.

Figure 2:
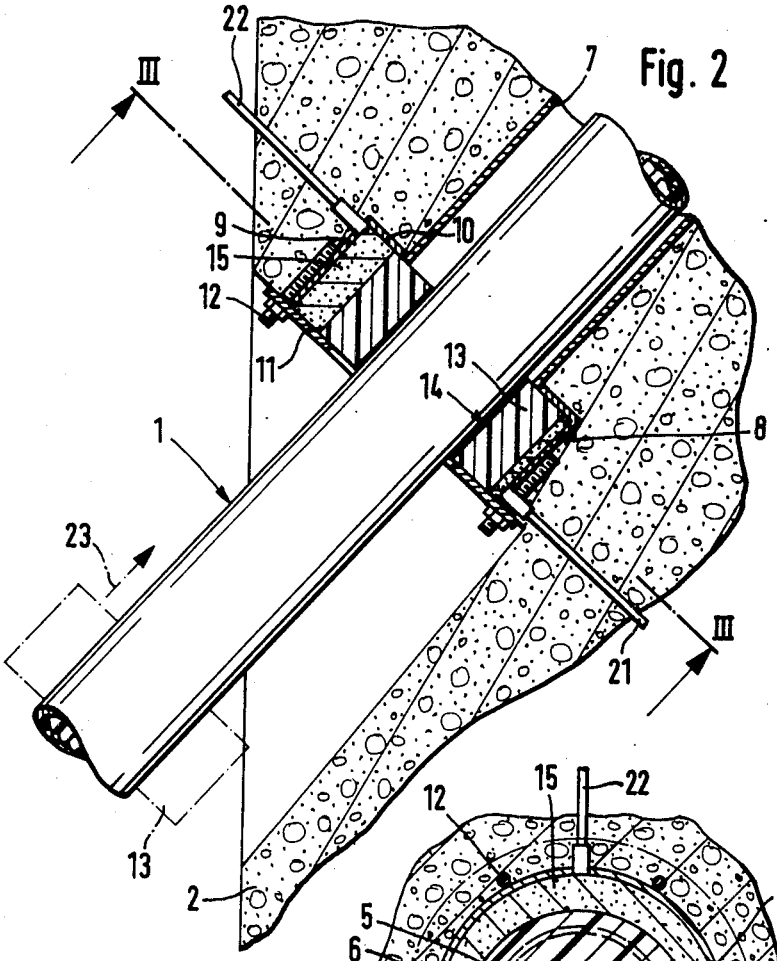
FIG. 2 is an enlarged sectional view of the detail II in FIG. 1.
Figure 4:
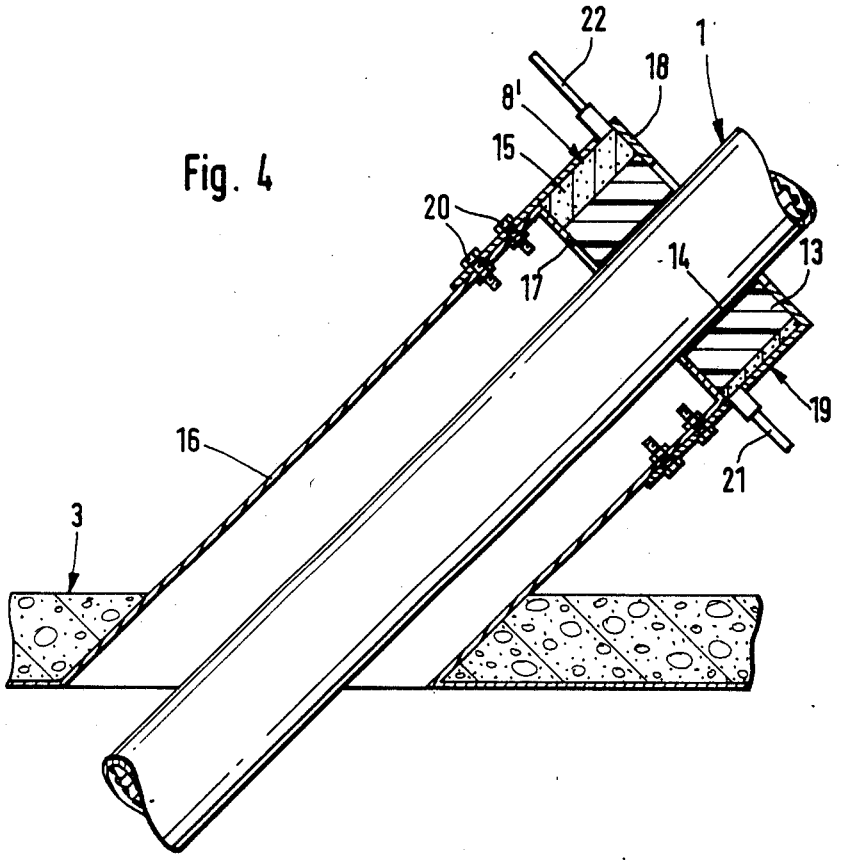
FIG. 4 is a sectional view on an enlarged scale of the detail IV in FIG. 1.

To intercept movements of the cable transverse to its long direction in the region where it enters into the tower 2 or into the roadway girder 3, supports are provided shown on an enlarged scale in FIGS. 2 and 4. FIG. 2 illustrates the detail II of FIG. 1 at the location where the cable l, passing upwardly from the roadway girder, enters into the tower 2. Similarly, FIG. 4 displays the detail IV of FIG. 1 at the location where the cable 1 enters into the roadway girder 3.

As can be seen in FIG. 2, cable 1 is guided through the tower 2 through a steel tubular member 7. The tube is embedded in the concrete during the construction of the tower 2 and extends through the tower to the location of the anchor unit A, however, it is not the subject of the invention and, therefore, is not displayed in FIG. 2. The passageway formed by the tubular member 7 extends from the side of the tower 2 adjacent the anchor unit A into an annular chamber 8 formed in the opposite surface of the tower. The annular chamber 8 is formed by a short steel tubular member 9 connected, such as by welding, to the tubular member 7 via an annular flange 10. The annular chamber 8 has a larger diameter than the tubular member 7 so that the side surface of the tubular member 9 is spaced radially outwardly from the tubular member 7 with the annular flange 10 extending transversely of the axis of the tubular members. The opposite side of the annular chamber 8 from the flange 10 is closed by an annular pressure plate 11. As illustrated, the tubular member 9 is embedded in the concrete of the tower 2 along with the tubular member 7. The pressure plate 11 is attached from the outside and secured by screws 12. It would be possible, however, to form the annular chamber 8 in another way, for example, as a recess formed in the surface of the tower structure.

Positioned in the annular chamber 8 is an annular bearing member 13 formed of an elastomer material, such as neoprene, which closely encircles the protective casing 5 of the cable 1. A sliding layer in the form of a thin sheet metal strip 14 is provided around the outside surface of the protective casing 5 in contact with the radially inner surface of the bearing member 13. The sliding layer 14 affords possible subsequent movement of the cable, such as post-tensioning or relaxing of the tension force. The outside diameter of the bearing member 13 is smaller than the inside diameter of the annular chamber 8 defined by the inside surface of the tubular member 9 so that certain tolerances can be accepted in the radial direction during the installation of the cable 1 which installation takes place after the tower 2 is constructed. In FIGS. 2 and 3 the diagonal cable 1 is shown in an eccentric position relative to the annular chamber 8.

To fix the cable 1 relative to the tower 2 and to allow the support by the bearing member 13 to become effective, the space remaining in the annular chamber 8 between the radially outer surface of the bearing member and the inside surface of the chamber, closed on the opposite side of the chamber by the flange 10 and the pressure plate 11, is filled by grouting with a hardenable material 15, such as cement mortar or a plastics material. Accordingly, a grouting line 21 and a vent line 22 are connected to the annular chamber 8.

According to the method of the invention, in the installation of the diagonal cable 1, initially the tubular member 7 along with the tubular member 9 and the flange 10 are embedded in concrete of the tower 2 when it is poured. Next, the assembled cable 1 is inserted through the passageway formed by the tubular members 7, 9 into the anchor unit where the cable is anchored. At this point, the bearing member 13 is located on the cable 1, either it is slid onto the cable in the form of a closed ring during the asembly of the cable or it is placed around the cable in the form of a open ring by spreading it. At this point, the bearing member 13 is still located outside the annular chamber 8 as shown in the dot-dash lines in FIG. 2. After installing the cable, including tensioning and grouting the cable with any possible post-tensioning or relaxing in order to attain its final position, the bearing member 13 is moved into the annular chamber by displacing it along the protective casing 5 in the direction of the arrow 23. With the bearing member 13 within the annular chamber, the pressure plate 11 is attached and an axial pressure is exerted on the bearing member 13 when the screws 12 are tightened. The axial pressure seals the space relative to the surfaces of the annular chamber 8 defined by the flange 10 and the pressure plate 11 due to transverse expansion. In addition, an airright contact is provided between the bearing member 13 and the protective casing 5. At this point, the space within the annular chamber 8 around the radially outer surface of the bearing member is filled by grouting a hardenable material into the space.

The cable 1 is anchored in the roadway girder in a similar manner, note the arrangement shown in FIG. 4. Since in many instances the height of the roadway structure is insufficient to space the support of the cable a correspondingly great distance from the anchor unit, a steel support tube 16 is embedded in the concrete of the roadway girder 3 and the support tube extends upwardly inclined toward the tower 2. The support tube 16 is secured in the roadway girder so that it is bending resistant and projects upwardly from the upper surface of the roadway for a certain length. Adjacent its end spaced upwardly from the roadway girder 3, a flange 17 extends transversely of the axis of the support tube 16 and forms the inner boundary of an annular chamber 8' located at the end of the support tube spaced from the surface of the roadway. Another flange 18 forms the end of the chamber spaced outwardly from the flange 17 with a tubular section 19 forming the radially outer boundary of the annular chamber 8' between the two flanges. The tubular section 19 is slightly larger in diameter than the support tube 16 so that it can be slipped onto the end of the support tube and connected to it by screws 20. The construction of the support is carried out in a manner similar to that of the support at the tower. The bearing member 13 is slid along the outside surface of the protective casing 5 on the cable 1 during assembly with the sliding layer 14 being located between the casing and the radially inner surface of the bearing member. After the completion of the assembly and anchoring of the cable, the bearing member is moved along the cable toward the support tube 16 until it contacts the flange 17. Next, the tubular section 19 is placed over the end of the support tube 16 and is moved along the support tube until the two flanges 17 and 18 press against the bearing member 13 and provide a seal for the annular chamber 8'. After completeing any adjustment and final anchoring of the cable 1, the remaining space within the annular chamber 8' around the radially outer surface of the bearing member 13 is filled by grouting a hardenable material 15, such as a cement mortar or a plastics material mortar, into the space so that the bearing is fixed and the support for the cable is completed.

While specific embodiments of the invention have been shown and described in detail to illustrate the application of the inventive principles, it will be understood that the invention may be embodied otherwise without departing from such principles.

We claim:

1. A support for an axially extending tension tie member, such as a diagonal cable in a stayed girder bridge, extending in the axial direction thereof unsupported between spaced anchor locations on a structure, said tension tie member being anchored to the structure at each of the spaced locations, anchor said tension tie member comprising axially elongated steel strand-like members, an axially elongated protective casing laterally enclosing said strand-like members, said support located adjacent at least one of the spaced anchor locations on the structure, wherein the improvement comprises that said support includes an annular bearing member extending in the axial direction of said tension tie member laterally encircling and in surface contact with the protective casing of said tie member at a position spaced from the at least one of the spaced anchor locations, an annular chamber extending in the axial direction of said tension tie member laterally encircling said annular bearing member said tie member extends through said protective casing into the structure from the other said spaced anchor location, the inside diameter of said annular chamber being larger than the outside diameter of said bearing member and forming an open space therebetween, and grout filling the open space in said annular chamber between the outside surface of said bearing member and the inside surface of said chamber for fixing said bearing member to the structure.

2. A support, as set forth in claim 1, wherein said annular chamber is formed as a recess in said structure.

3. A support, as set forth in claim 1, wherein a support tube is secured to and extends outwardly from the structure on the opposite side thereof from the location of said at least one of the spaced anchor locations, with the end of said support tube spaced outwardly from the structure forming said annular chamber and the opposite end of said support tube from said annular chamber being securely fixed in said structure.

4. A support, as set forth in claim 3, wherein said support tube is formed of steel.

5. A support, as set forth in one of claims 1 to 4, wherein said bearing member is comprises a closed ring and can be slipped onto said tie member.

6. A support, as set forth in one of claims 1 to 4, wherein said bearing member comprises an open ring so that the opening in the ring can be spread apart for placing said bearing member on said tie member.

7. A support, as set forth in claim 5, wherein said closed ring is formed of one of a group consisting of rubber and plastics material.

8. A support, as set forth in claim 6, wherein said open ring is formed of one of a group consisti.ng of rubber and elastics material.

9. A support, as set forth in claim 5, wherein said bearing member includes a sliding layer provided between said closed ring and the outside surface of said tie member.

10. A support, as set forth in claim 6, wherein said bearing member includes a sliding layer provided between said open ring and the outside surface of said tie member.

11. A support, as set forth in claim 9, wherein said sliding layer is formed of a sheet metal strip.

12. A support, as set forth in claim 10, wherein said sliding layer is formed of a sheet metal strip.

13. A support, as set forth in one of claims 1 to 4, wherein a coating for inhibiting bonding of the hardenable material is placed on the axially extending surfaces forming the inside of said annular chamber.

14. A method of forming a support for an axially elongated tension tie member extending continuously between spaced anchor locations on a structure with the tie member being anchored to the structure at each of the spaced anchor locations, said tie member having a tube-like protective casing at at least one end thereof, comprising the steps of forming an annular chamber in the structure adjacent and spaced from the at least one of the spaced anchor locations at the point where the tie rod member extends into the structure from the other spaced location with the annular chamber being open at the surface of the structure opposite the adjacent spaced anchor location, placing an annular bearing around and in surface contact with the protective casing of the tension tie member and inserting the bearing member into the annular chamber through the opening thereto with the radially outer surface of the bearing member being spaced inwardly from the surface of the annular chamber encircling the protective casing, closing the opening to the annular chamber, applying pressure to the bearing member in the axial direction of the tie member for effecting a seal around the protective casing at the opposite ends of the bearing member spaced apart in the long direction of the tie member, and grouting the space between the inner surface of the annular chamber encircling the protective casing and the radially outer surface of the bearing member with a hardenable material.

15. A method, as set forth in claim 14, wherein the grouting of the space between the surface of the annular chamber and the bearing member is effected after tensioning the tie member to a selected tension.

* * * * *

UNITED STATES PATENT AND TRADEMARK OFFICE

CERTIFICATE OF CORRECTION

PATENT NO. : 4,648,147

DATED : March 10, 1987

INVENTOR(S) : Egbert Zimmermann and Oswald Nützel

It is certified that error appears in the above-identified patent and that said Letters Patent is hereby corrected as shown below:

In the heading of the patent, it should read:

-- [73] Assignee: Dyckerhoff & Widmann Aktiengesellschaft, Federal Republic of Germany

Signed and Sealed this

Eighteenth Day of August, 1987

*Attest:*

DONALD J. QUIGG

*Attesting Officer*

*Commissioner of Patents and Trademarks*